US005486131A

United States Patent [19]

Cesna et al.

[11] Patent Number: 5,486,131

[45] Date of Patent: Jan. 23, 1996

[54] DEVICE FOR CONDITIONING POLISHING PADS

[75] Inventors: Joseph V. Cesna, Niles, Ill.; Anthony G. Van Woerkom, Gilbert, Ariz.

[73] Assignee: Speedfam Corporation, Des Plaines, Ill.

[21] Appl. No.: 177,156

[22] Filed: Jan. 4, 1994

[51] Int. Cl.[6] ..... B24B 1/00

[52] U.S. Cl. ..... 451/56; 451/443; 451/444; 451/548; 451/159; 451/173; 451/285; 451/413

[58] Field of Search ..... 51/54, 55, 56 R, 51/67, 117, 118, 123 R, 129, 131.1, 131.3, 131.4, 262 R, 262 T, 262 A, 5 B, 5 C, 5 D, 236, 240 T, 237 R, 325; 451/548, 550, 41, 56

[56] References Cited

U.S. PATENT DOCUMENTS

| | | | |
|---|---|---|---|
| 4,102,084 | 7/1978 | Bloomquist | 451/357 |
| 4,663,890 | 5/1987 | Brandt | 451/548 |
| 4,720,938 | 1/1988 | Gosis | 51/131.1 |
| 4,760,668 | 8/1988 | Schlaefli | 51/5 D |
| 5,081,051 | 1/1992 | Mattingly et al. | 51/325 |
| 5,216,843 | 1/1993 | Breivogel et al. | 51/131.1 |

OTHER PUBLICATIONS

Exhibit A—Sketch.

*Primary Examiner*—Bruce M. Kisliuk
*Assistant Examiner*—Eileen P. Morgan
*Attorney, Agent, or Firm*—Fitch, Even, Tabin & Flannery

[57] ABSTRACT

A device for conditioning the surface of a polishing pad covering a platen mounted on a polishing machine for rotation about a vertical axis, comprising a rigid carrier element carrying cutting means on its bottom surface and which is adapted for vertical movement into and out of engagement with the surface of a polishing pad and which is adapted for oscillating horizontal movement over the surface of the polishing pad. The cutting means are dispersed in a circular or ring configuration.

10 Claims, 1 Drawing Sheet

DEVICE FOR CONDITIONING POLISHING PADS

This invention relates to the art of machining work pieces which includes polishing or planarization of thin work pieces such as thin wafers or discs of silicon that are used for the fabrication of solid state circuit components. More particularly, the present invention relates to the conditioning of polishing pads carried by rotatable platens used to polish or planarize such work pieces.

In machining processes such as polishing or planarization of thin work pieces such as silicon substrates or wafers with integrated circuits, a wafer is disposed between a load or pressure plate and a rotatable polishing platen with the pressure plate applying a pressure so as to effect removal of rough spots from the wafer and to produce a surface of substantially uniform thickness on the wafer.

The preferred type of machine with which the present invention is used includes an abrading, lapping or polishing wheel assembly which is rotatably driven about a vertical axis such that work pieces may be engaged with the upper surface of the wheel assembly and polished or abraded by means of an abrasive slurry. In general, the polishing wheel comprises a horizontal ceramic or metallic platen covered with a polishing pad that has an exposed abrasive surface of, for example, cerium oxide, aluminum oxide, fumed/precipitated silica or other particulate abrasives. The polishing pads can be formed of various materials, as is known in the art, and which are available commercially. Typically, the polishing pad is a blown polyurethane, such as the IC and GS series of polishing pads available from Rodel Products Corporation in Scottsdale, Ariz. The hardness and density of the polishing pad depends on the type of material that is to be polished. The polishing pad is rotated about a vertical axis and has an annular polishing surface on which the work pieces are placed in confined positions so that movement of the platen and the superimposed attached polishing pad relative to the work pieces brings about abrasive wear of the latter at their surfaces in engagement with said polishing surface. Of importance in all such machines is the maintenance of the polishing pad surface in planar condition and substantially free of surface irregularities. It is well known that the polishing pads tend to wear unevenly in the polishing operation and surface irregularities develop therein which must be corrected.

It is therefore a principal object of this invention to provide for conditioning of polishing pads after use to remove surface irregularities and achieve a planar pad condition.

It is another object of this invention to provide a simple device for conditioning of polishing pads after use to remove surface irregularities and achieve a planar pad condition.

The present invention provides a device for conditioning the surface of a polishing pad covering a platen mounted on a polishing machine for rotation about a vertical axis, comprising a rigid carrier element carrying cutting means on its bottom surface and which is adapted for vertical movement into and out of engagement with the surface of a polishing pad and which is adapted for oscillating horizontal movement over the surface of the polishing pad. The cutting means are dispersed in a circular or ring configuration. Generally, the carrier is formed of a metal or ceramic in the form of a circular ring.

The cutting means carried on the bottom surface of the conditioning carrier element involve a hard material which presents a sharp face to the polishing pad so as to accomplish truing and dressing of the polishing pad. Representative of said hard, sharp cutting elements are diamond particles or grits, polycrystalline chips-slivers, and saw blades such as band saw blades with the regular alternate type, i.e., one bent to the right and the next to the left, or with the alternate and center set in which one tooth is bent to the right, the second to the left and the third straight in the center.

The cutting means secured to the bottom surface of the conditioning carrier element only contact the polishing pad when the carrier element is lowered into conditioning position. The cutting elements can be secured to the bottom surface of the carrier element by various means such as, for example, by use of known bonding agents such as resins, rubber, shellac, vitrified bonds and the like.

This invention and the advantages thereof will become further apparent from the following description taken in conjunction with the drawings wherein.

Figure 1:
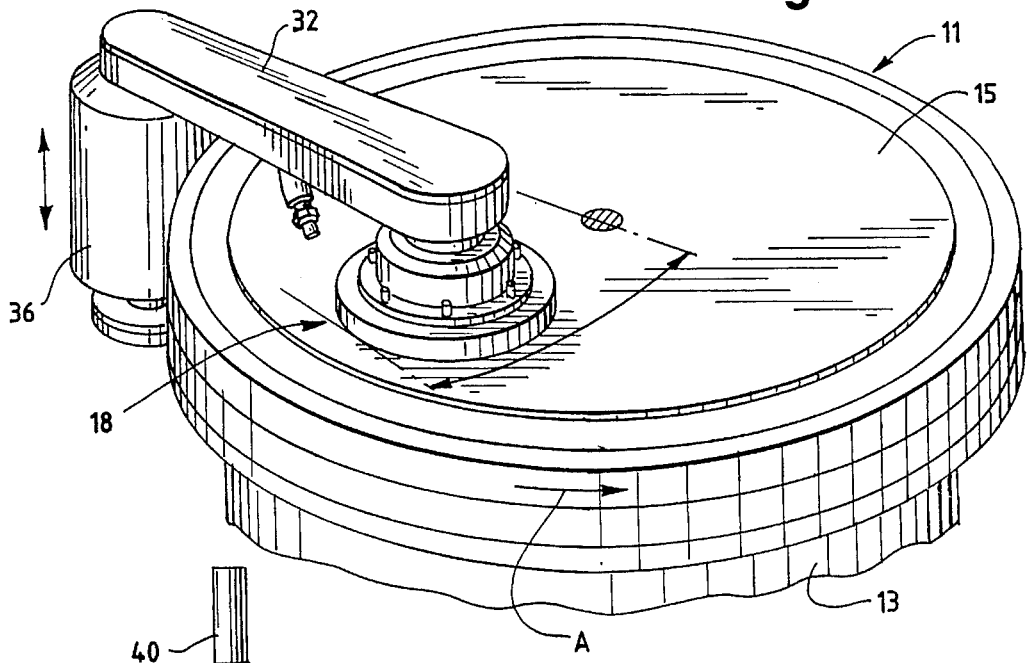
FIG. 1 is a perspective view showing a conditioning device of this invention in operative position for conditioning a polishing pad used on rotatable platens of machining apparatus.

Referring to the drawings, numeral 11 refers to a rotatable lap wheel supported on a support 13 to rotate about a central axis in the direction shown by arrow A. A polishing pad 15, such as IC-1000 available from Rodel Products Corporation of Scottsdale, Ariz., comprises the top surface of the lap wheel. The conditioning device 18 of the invention is most advantageously used to condition polishing pads which are generally considered to be hard pads, that is, one having a hardness of about 60 or greater on the Shore D hardness scale.

The conditioning device 18, as illustrated, comprises a circular ring carrier element 20 made of a rigid material, such as ceramic or metal, provided with a circumferentially downwardly depending peripheral flange portion 22 which contacts the polishing pad for conditioning thereof. The depending flange portion 22 is interrupted by a plurality of cut-outs 23 circumferentially disposed therearound. These cut-outs permit sworf and fluids to escape from the interior of the conditioning device 18.

As illustrated in the drawings, the cutting elements are finely divided diamond particles 25 secured to the bottom surface of flange portion 22. The particle size of the diamond particles can be varied, depending upon the degree of pad conditioning necessary or desired. Larger size diamond particles provide a deeper cutting action on the pad and vice-versa. The same is true with other cutting elements such as toothed saw blades. Generally, the preferred size of the diamond particles used is smaller than about 80 mesh, U.S. Sieve Series, and more preferably in the range of about 100 to 120 mesh, U.S. Sieve Series.

While the outer diameter of the ring carrier element 20 will vary depending upon the size of the polishing pad undergoing conditioning, its outer diameter is such to insure that the conditioning device traverses the entire diameter of the pad when oscillated thereover. For example, in the case of a polishing pad having a diameter of 32 inches, a preferred conditioner is one in which the outer diameter of ring 20 is about 10 inches and the inner diameter of depending flange 22 is about 9.5 inches. In such case, the width of the depending flange 22 which carries the diamond particles is approximately ½ inch in width. The width of the flange 22 is important and it must not be so wide as to cause hydroplaning when the conditioner is in use. Generally, the width of the flange 22 ranges from about ⅛ to ½ inch.

Figure 2:
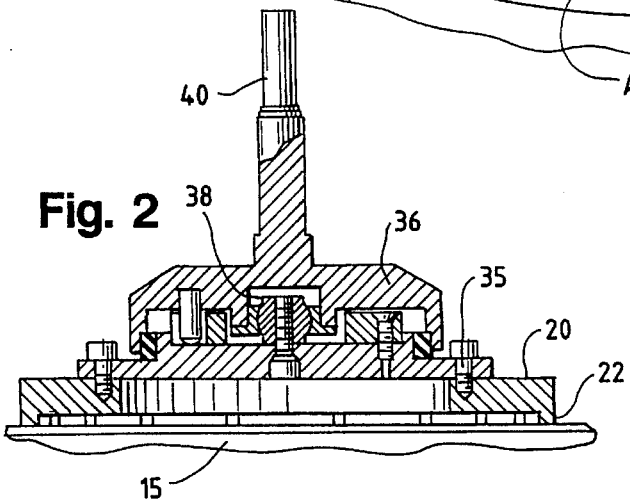
FIG. 2 is a sectional type view showing an illustrative mounting of the pad conditioning device of the invention.
Figure 3:
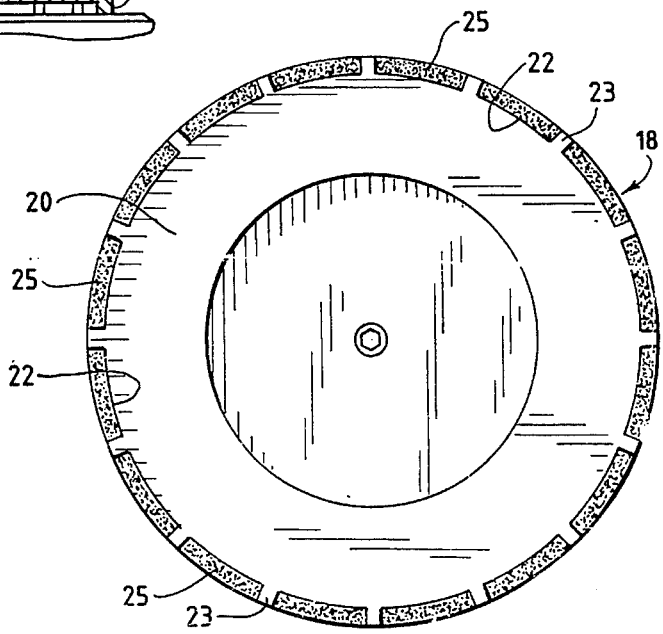
FIG. 3 is a bottom view of a polish pad conditioning device of this invention.

The conditioning device 18 can be attached to operating arm 32 which is adapted for vertical movement so as to raise and lower the conditioner into and out of engagement with the polishing pad. The operating arm 32 is adapted for vertical movement through pressure cylinder 36. Arm 32 is also adapted for oscillating horizontal movement so that the conditioning device 18 traverses the entire top surface of the polishing pad. The specific structure of operating arm 32 is not of concern with respect to the present invention. Operating arms which function to bring the conditioner 18 into engagement with the polishing pad and to oscillate the conditioner over the surface of the pad are well known in the lapping art. Thus, an operating arm, such as arm 32, can be of the type described in U.S. Pat. No. 4,141,180. Various means can be employed to connect the pad conditioning device 18 to operating arm 32. For example, as illustrated in FIG. 2, the inwardly extending ring 20 can, by means of shoulder bolts 35, be secured to a bearing housing 36 in which there is disposed a self-aligning bearing 38. Shaft 40 is configured to be engageable within a chuck in the head of the operating arm 32.

When a polishing pad is in need of conditioning to remove surface irregularities or to impart a desired geometric shape thereto, the conditioning device of this invention is attached to operating arm 32. The arm is then activated to move in a vertically downward direction so as to bring the cutting means on the bottom surface of the conditioning device into contact with the top surface of the polishing pad. The downward pressure exerted on the polishing pad surface by the conditioning device can be varied as determined by the operator. The lap wheel is caused to rotate, as illustrated, in counterclockwise direction and at the same time the operating arm oscillates to cause the ring-shaped conditioner 18 to traverse at least 50% of the diameter of the surface of the polishing pad 15. The conditioning operation is conducted under suitable pressure for a period to achieve a desired conditioning of the polishing pad as observed by the operator.

The size of the cutting element employed on the bottom surface of the conditioning element of the invention can be varied as desired to achieve a truing and/or dressing action on the polishing pad. In truing, the conditioning element is engaged with the rotating polishing pad under pressure so as to remove enough material from the pad to give the pad its true geometric shape. Dressing is a more severe operation to remove material loaded on the polishing pad.

For satisfactory conditioning of a polishing pad, including truing and dressing, it is essential that the sharp cutting elements be disposed only in a circular configuration. Conditioning devices in which the cutting elements are disposed in other geometric configurations, such as star-shaped, do not provide the desired conditioning effect.

The unique advantages of the conditioning device of this invention include the ability to provide perfectly a true spherical contour when a polishing pad suffers wear from use in a polishing process. The circular configuration of the cutting elements recuts and resharpens the polishing pad surface between polishing cycles and generates criss-cross pattern on the pad providing more aggressive truing and dressing actions than other dressing tool shapes.

Those modifications and equivalents which fall within the spirit of the invention are to be considered a part thereof.

What is claimed is:

1. A process for simultaneously truing and dressing a polishing pad covering a platen mounted on a polishing machine for rotation about a vertical axis which comprises while said polishing pad is being rotated bringing under pressure into contact with the top exposed surface of said polishing pad and oscillating over the said pad surface a carrier element adapted for vertical movement into and out of substantially perpendicular engagement with the surface of a polishing pad and for oscillating radial movement over the surface of the polishing pad, said carrier element being in the shape of a ring and carrying on its bottom surface cutting means disposed in a circular ring configuration for truing and dressing the polishing pad by contact therewith.

2. A process in accordance with claim 1 wherein the carrier element is provided with spaced cut-out portions along its periphery to permit materials to escape from the interior of the carrier element.

3. A process in accordance with claim 1 wherein the cutting means comprises diamond particles.

4. A process in accordance with claim 3 in which the diamond cutting means have a particle size of not larger than about 60 mesh, U.S. Sieve Series.

5. A process in accordance with claim 1 wherein the cutting elements comprise a blade having cutting teeth thereon.

6. A device for simultaneously truing and dressing a polishing pad covering a platen mounted on a polishing machine for rotation about a vertical axis, comprising a carrier element adapted for vertical substantially perpendicular movement into and out of engagement with the surface of a polishing pad and for oscillating radial movement over the surface of the polishing pad, said carrier element having a ring-shaped flange downwardly depending from its bottom surface carrying cutting means for truing and dressing the polishing pad by contact therewith.

7. A device in accordance with claim 6 having spaced cut-out portions along the periphery of the flange element to permit materials to escape from the interior of the carrier element.

8. A device in accordance with claim 6 wherein the cutting means comprises diamond particles.

9. A device in accordance with claim 8 in which the diamond cutting means have a particle size of not larger than about 80 mesh, U.S. Sieve Series.

10. A device in accordance with claim 6 wherein the cutting means comprise a circular blade having cutting teeth thereon.

* * * * *